US006946804B2

(12) United States Patent
You

(10) Patent No.: US 6,946,804 B2
(45) Date of Patent: Sep. 20, 2005

(54) DISPLAY DEVICE

(75) Inventor: Bong-Hyun You, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 70 days.

(21) Appl. No.: 10/637,328

(22) Filed: Aug. 8, 2003

(65) Prior Publication Data

US 2004/0104903 A1 Jun. 3, 2004

(30) Foreign Application Priority Data

Aug. 8, 2002 (KR) ..... 10-2002-0046815

(51) Int. Cl.[7] ..... G09G 3/10
(52) U.S. Cl. ..... 315/169.4; 345/87; 347/5
(58) Field of Search ..... 315/169.1, 169.4; 345/87; 347/5, 9, 57; 370/284

(56) References Cited

U.S. PATENT DOCUMENTS 6,631,962 B2 * 10/2003 Rehmann et al. ..... 347/5
2003/0025740 A1 * 2/2003 Rehmann et al. ..... 347/5
2004/0178976 A1 * 9/2004 Jeon et al. ..... 345/87

* cited by examiner

*Primary Examiner*—Tan Ho
*Assistant Examiner*—Jimmy Vu
(74) *Attorney, Agent, or Firm*—MacPherson Kwok Chen & Heid LLP

(57) ABSTRACT

A display device is provided, which includes: first and second signal lines for transmitting data in differential transmission; a termination resistor connected between the first signal line and the second signal line, and defining a voltage based on difference between signals transmitted by the first and the second signal lines; and a differential signal receiver, connected across the termination resistor, for receiving and converting the data based on the voltage defined by the termination resistor, wherein the differential signal receiver and the termination resistor are integrated into an integrated circuit.

5 Claims, 2 Drawing Sheets

DISPLAY DEVICE

BACKGROUND OF THE INVENTION (a) Field of the Invention

The present invention relates to a display device.

(b) Description of the Related Art

A liquid crystal display (LCD) among display devices includes an upper panel provided with a common electrode and an array of color filters and a lower panel provided with a plurality of thin film transistors (TFT) and a plurality of pixel electrodes. Alignment layers are coated on the upper panel and the lower panel, and a liquid crystal layer is interposed between the alignment layers. Application of different voltages to the pixel electrodes and the common electrode generates an electric field, and liquid crystal molecules in the liquid crystal layer are reoriented by adjusting the electric field. The change of the orientations of the liquid crystal molecules in turn changes the transmittance of light passing through the liquid crystal layer, and thus desired images can be obtained by controlling the voltage difference between the pixel electrodes and the common electrode.

The voltages applied to the pixel electrodes and the common electrode are selectively transmitted from a plurality of circuit elements for driving and controlling the voltages, and the voltages applied to the pixel electrodes are switched by the TFTs. The circuit elements include a gate driver supplying gate signals for turning on and turning off the TFTs, a data driver supplying data voltages to be applied to the pixel electrodes, and a timing controller for controlling the gate driver and the data driver and transmitting image data from an external source to the data driver.

A plurality of transmission lines are required for signal transmission in an LCD, and they generate a lot of electromagnetic interference (EMI) the data. Differential transmission such as LVDS (low voltage differential signaling) and RSDS (reduced swing differential signaling) is suggested for reducing the EMI. LVDS is usually used for data transmission for a system to an LCD, and RSDS is generally used for the data transmission from the signal controller to the gate driver and the data driver.

The differential transmission transmits data in pairs of positive and negative signals. Since the data are recognized as the difference between the voltages of the pairs of positive and negative signals, data loss due to noise is reduced. In addition, the electromagnetic waves from the pairs of positive and negative signals are cancelled to reduce EMI.

A conventional technique provides termination resistors for detecting the voltage difference between positive signals and negative signals in pairs at external input terminals of a differential signal amplifying circuit. Since a termination resistor is required for a couple of transmission lines, the number of the termination resistors is determined by the number of the transmission line. For example, 8-bit data transmission using four data channels and one clock channel requires five termination resistors.

Generally, a differential signal amplifying circuit is implemented as a chip mounted on the PCB, while termination resistors therefor are formed on a printed circuit board (PCB) instead of being incorporated into the chip. Accordingly, shapes and positions of the termination resistors depend on sizes and positions of the PCB and the chip and the termination resistors may be spaced apart from the chip. The existence of the termination resistors on the PCB yields complexity in design of the PCB, and long and curved transmission lines for connecting the termination resistors and the chip on the PCB increase EMI.

SUMMARY OF THE INVENTION

A motivation of the present invention provides a display device having an improved differential configuration with termination resistors.

A display device is provided, which includes: first and second signal lines for transmitting data in differential transmission; a termination resistor connected between the first signal line and the second signal line, and defining a voltage based on difference between signals transmitted by the first and the second signal lines; and a differential signal receiver, connected across the termination resistor, for receiving and converting the data based on the voltage defined by the termination resistor, wherein the differential signal receiver and the termination resistor are integrated into an integrated circuit.

According to an embodiment of the present invention, the display device further includes a panel including a plurality of pixels and a printed circuit board provided with a signal controller for driving the panel based on the converted data, and the integrated circuit is formed on the PCB. The differential transmission preferably includes low voltage differential signaling ("LVDS").

According to an embodiment of the present invention, the display device further includes a panel including the pixels and a signal controller for outputting signals for driving the panel through the first and the second signal lines in differential transmission, and the integrated circuit receives the signals from the signal controller and transmits the signals to the panel. The differential transmission preferably includes reduced swing differential signaling ("RSDS").

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
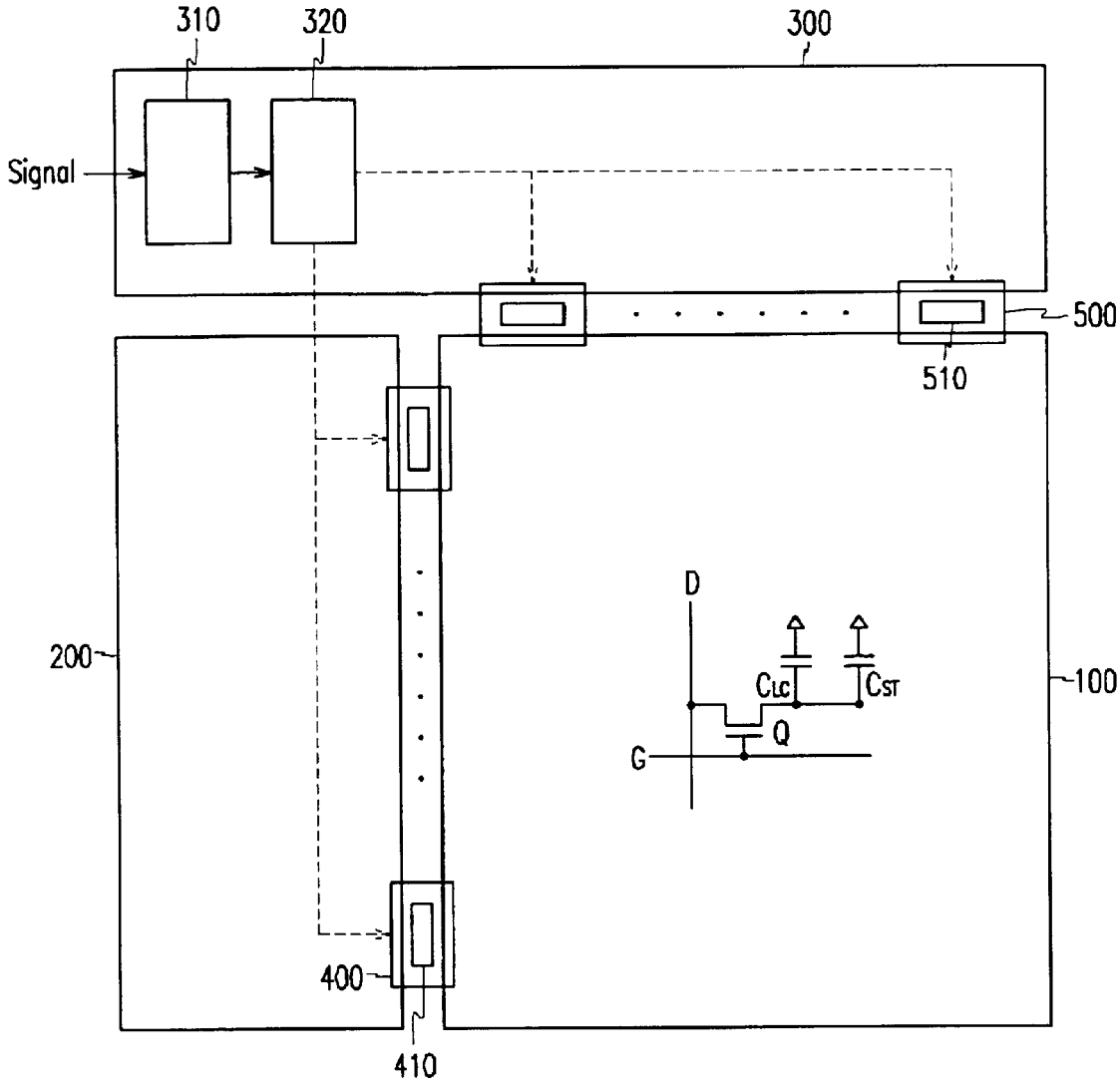
FIG. 1 schematically shows an LCD according to an embodiment of the present invention.

The present invention now will be described more fully hereinafter with reference to the accompanying drawings, in which preferred embodiments of the invention are shown. The present invention may, however, be embodied in many different forms and should not be construed as limited to the embodiments set forth herein.

In the drawings, the thickness of layers, films, panels, regions, etc. are exaggerated for clarity. Like numerals refer to like elements throughout. It will be understood that when an element such as a layer, film, region or substrate is referred to as being "on" another element, it can be directly on the other element or intervening elements may also be present. In contrast, when an element is referred to as being "directly on" another element, there are no intervening elements present.

Then, display devices such as liquid crystal displays according to an embodiment of the present invention display device are described in detail with reference to the drawings.

An LCD according to an embodiment of the present invention is described in detail with reference to FIGS. 1 and 2.

Figure 2:
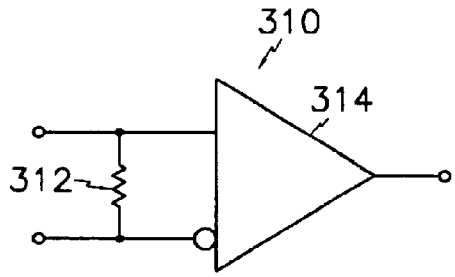
FIG. 2 shows a differential signal receiver according to an embodiment of the present invention.

FIG. 1 shows a schematic configuration of an LCD according to an embodiment of the present invention LCD, and FIG. 2 illustrates a differential signal receiver according to an embodiment of the present invention.

Referring to FIG. 1, an LCD according to an embodiment of the present invention includes a liquid crystal panel assembly 100, a gate printed circuit board (PCB) 200, a data PCB 300, a plurality of gate tape carrier packages (TCPs) 400, and a plurality of the data TCPs 500. The gate TCPs 400 are attached to the liquid crystal panel assembly 100 and the gate PCB 200, while the data TCPs 500 are attached to the liquid crystal panel assembly 100 and the data PCB 300. The gate PCB 200 and the data PCB 300 are electrically connected to each other for signal transmission between the PCBs 200 and 300. The gate PCB 200 and the data PCB 300 are disposed beyond left and top of the liquid crystal panel assembly 100, respectively.

The liquid crystal panel assembly 100 includes a plurality of the gate lines G extending in a transverse direction, a plurality of the data lines D extending in a longitudinal direction, and a plurality of pixels connected to the gate lines G and the data lines D.

Each pixel includes a switching element Q connected to the gate line G and the data line D, and an LC capacitor $C_{LC}$ and a storage capacitor $C_{ST}$ that are connected to the switching element Q. The storage capacitor $C_{ST}$ may be omitted if unnecessary.

The switching element Q such as a TFT has three terminals: a control terminal connected to the gate line G; an input terminal connected to the data line D; and an output terminal connected to the LC capacitor $C_{LC}$ and the storage capacitor $C_{ST}$.

The LC capacitor $C_{LC}$ includes a pixel electrode (not shown), a common electrode (not shown), and a liquid crystal layer (not shown) as a dielectric between the pixel electrode and the common electrode. The pixel electrode is connected to the switching element Q, and the common electrode is supplied with a common voltage.

The storage capacitor $C_{ST}$ is an auxiliary capacitor for the LC capacitor $C_{LC}$. The storage capacitor $C_{ST}$ includes the pixel electrode and a separate signal line (not shown), which is supplied with a predetermined voltage such as the common voltage. Alternatively, the storage capacitor $C_{ST}$ includes the pixel electrode and an adjacent gate line called a previous gate line.

A differential signal receiver 310 and a signal controller 320 are provided on the data PCB 300, but they may be provided on the gate PCB 200. A driving voltage generator (not shown) generating a gate-on voltage, a gate-off voltage, and a common voltage and so on are provided on the gate PCB 200, while a gray voltage generator (not shown) generating a plurality of gray voltages, etc. are provided on the data PCB 300.

According to another embodiment of the present invention, at least one of the gate PCB 200 and the data PCB 300 is omitted, and circuits and signal paths related thereto may be formed on the liquid crystal panel assembly 100 or other PCB.

A gate driving integrated circuit (IC) 410 is chip-mounted on each gate TCP 400, while a data driving IC 510 is chip-mounted on each data TCP 500. The gate TCPs 400 and the data TCPs 500 are attached to the gate PCB 200 and the data PCB 300 to be electrically connected thereto, respectively. The gate TCPs 400 and the data TCPs 500 are also attached to the liquid crystal panel assembly 100 such that they are electrically connected to the gate lines G and the data lines D on the liquid crystal panel assembly, respectively. Otherwise, the gate driving ICs 410 and/or the data driving ICs 510 are directly mounted on the liquid crystal panel assembly 100, which is called a chip-on-glass (COG) type.

The differential signal receiver 310 receives the data signals and clock signals transmitted in differential transmission from a system (not shown), converts the signals into their original format, and output the signals to the signal controller 320. Examples of the differential signal transmission are LVDS (low voltage differential signaling) and RSDS (reduced swing differential signaling), and the latter is more generally used type.

The signal controller 320 provides a plurality of RGB image signals for the data driving ICs 510, and provides control signals for driving the driving ICs 410 and 510 for the driving ICs 410 and 510 via PCB 200 and 300.

The gate driving ICs 410 generate scanning signals based on the gate-on voltage and the gate-off voltage, and apply the scanning signals to the gate lines G in synchronization with the control signals from the signal controller 320. The data driving ICs 510 select data voltages among the gray voltages from the gray voltage generator based on the image signals from the signal controller 320, and apply the data voltages to the data lines D based on the control signals from the signal controller 320.

As shown in FIG. 2, the differential signal receiver 310 includes a termination resistor 312 connected between two signal lines transmitting differential signals and a receiving terminal 314 receiving the signals based on a voltage detected by the termination resistor 312. When differential signals with opposite polarities are transmitted through the signal lines, a current flowing from a positive signal to a negative signal to define the above-described voltage in the termination resistor 312. According to an embodiment of the present invention, the termination resistor 312 is integrated into an IC chip including the receiving terminal 314. That is, the differential signal receiver 310 including the termination resistor 312 and the receiving terminal 314 is implemented in an IC. The differential signal receiver 310 including the termination resistor 312 and the signal controller 314 may be implemented in a single IC chip.

As a result, since the termination resistor 312 is not separately formed on the data PCB 300, the noise due to elongation of transmission lines between the termination resistor 312 and the receiving terminal 314 on the data PCB 300 can be removed and unnecessary paths such as via holes for the transmission lines are removed to facilitate the design of the data PCB 300.

The integration of a differential signal receiver and termination resistors therefor can be applied to any differential receiver in an LCD.

An exemplary data driving IC including a differential receiver is described in detail with reference to FIG. 3.

Figure 3:
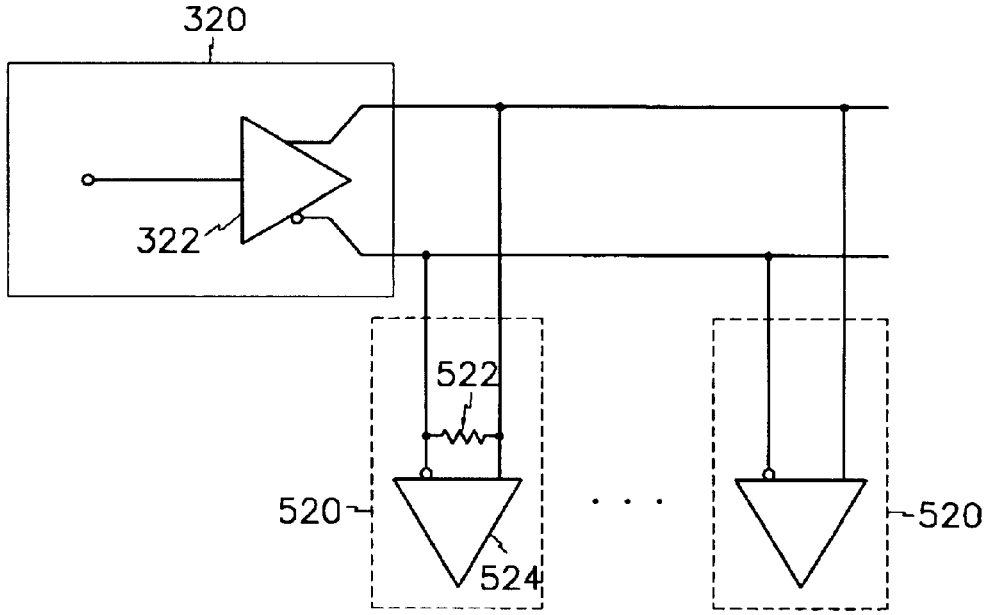
FIG. 3 shows a signal controller and a data driving IC according to an embodiment of the present invention.

FIG. 3 schematically shows a signal controller and a data driving IC connected thereto according to an embodiment of the present invention.

As shown in FIG. 3, a signal controller 320 according to an embodiment of the present invention includes a differential signal transmitter 322 for transmitting RGB image signals in differential transmission such as RSDS. A data driving IC 510 according to this embodiment includes a plurality of differential signal receivers 520 for receiving and converting the image signals from the differential signal transmitter 322. Each differential signal receiver 520 includes a termination resistor 522 for defining a voltage based on the image signals in differential transmission and a receiving terminal 524 for receiving the image signals depending on the voltage defined by the termination resistor 522. The termination resistor 522 and the receiving terminal 524 are incorporated into the data driving IC 510, and thus the wire configuration is simplified.

The integration of a differential signal receiver and termination resistors therefor can be applied to any differential receiver in any display device.

As described above, the integration of the receiving terminal and termination resistors therefor into a single chip PCB simplifies the wire configuration on a PCB, and the simple wire configuration reduces EMI and noise and facilitates the circuit design on the PCB.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A display device comprising:

first and second signal lines for transmitting data in differential transmission;

a termination resistor connected between the first signal line and the second signal line, and defining a voltage based on difference between signals transmitted by the first and the second signal lines; and a differential signal receiver, connected across the termination resistor, for receiving and converting the data based on the voltage defined by the termination resistor, wherein the differential signal receiver and the termination resistor are integrated into an integrated circuit.

2. The display device of claim 1, further comprising a panel including a plurality of pixels and a printed circuit board provided with a signal controller for driving the panel based on the converted data, wherein the integrated circuit is formed on the PCB.

3. The display device of claim 2, wherein the differential transmission comprises low voltage differential signaling ("LVDS").

4. The display device of claim 1, further comprising a panel including the pixels and a signal controller for outputting signals for driving the panel through the first and the second signal lines in differential transmission, wherein the integrated circuit receives the signals from the signal controller and transmits the signals to the panel.

5. The display device of claim 4, wherein the differential transmission comprises reduced swing differential signaling ("RSDS").

* * * * *